US005364326A

United States Patent [19]

Smith et al.

[11] Patent Number: 5,364,326

[45] Date of Patent: Nov. 15, 1994

[54] HYDRAULIC EXERCISE APPARATUS

[76] Inventors: Warren Smith, Box 85A; Donald Pank, Box 85B, both of Wentworth, Wis. 54874

[21] Appl. No.: 85,722

[22] Filed: Jul. 6, 1993

[51] Int. Cl.[5] ..... A63B 21/008

[52] U.S. Cl. ..... 482/113; 482/142; 482/133; 482/137; 482/135; 482/909

[58] Field of Search ..... 482/113, 112, 142, 133, 482/135, 136, 137, 909, 129, 130; 73/379.09, 379.01; 92/62, 82, 80

[56] References Cited

U.S. PATENT DOCUMENTS

| | | | |
|---|---|---|---|
| 3,822,599 | 7/1974 | Brentham . | |
| 4,465,274 | 8/1984 | Davenport | 482/113 |
| 4,478,412 | 10/1984 | Muir | 482/113 |
| 4,928,957 | 5/1990 | Lanier et al. | 482/113 |
| 5,114,389 | 5/1992 | Brentham | 482/113 |

*Primary Examiner*—Richard J. Apley
*Assistant Examiner*—Lynne A. Reichard
*Attorney, Agent, or Firm*—Douglas L. Tschida

[57] ABSTRACT

Exercise apparatus having a closed loop, hydraulic controller which provides a user selectable resistance to movement over an operating path. A restrictor valve assembly controls fluid flow in an exercise direction and includes a sealed valve body and a rotatable stem piece having a number of flow bores of differing relative dimension to a primary flow path. A pair of separable interlocking piston head pieces at a piston shaft control a reduced bypass resistance with return travel. Alternately disclosed modular frameworks, which include stationary and carriage portions, permit physical motion in relation to a measurement means which displays relative exertion.

23 Claims, 7 Drawing Sheets

HYDRAULIC EXERCISE APPARATUS

BACKGROUND OF THE INVENTION

The present invention relates to personal exercise equipment, and in particular, to a hydraulic assembly for selectively controlling the degree of exertion necessary to manipulate a movable framework in relation to a stationary framework.

With increasing numbers of individuals conscious of personal health and physical fitness, a need has developed for new types of exercise assemblies. Preferably, any such assembly should be usable year round, such as within an enclosed building.

A variety of stationary exercise equipment has accordingly been developed which permits single station or multi-station usage. Some of these assemblies are sold under the brand names NAUTILUS and NORDIC TRAC. Typically these assemblies include a user selectable weight or mass. The movement of the mass is controlled in relation to one or more movable members and interconnecting linkages. Some assemblies control movement in relation to controlled friction mechanisms, springs and spring-like mechanisms. Others control motion in relation to assemblies containing weights, chains, ropes and magnets.

Rowing assemblies also exist which include hydraulic assemblies capable of applying predetermined static amounts of resistance to separate handle motion. Applicants are also aware of various pneumatic and hydraulic exercise apparatus which include controlled flow paths to a sealed gas (i.e. air) and a liquid (i.e. water). The media are directed through in a variable path to provide controlled resistance to user motion.

Although many of the foregoing assemblies achieve the desired results of exercising the user, the assemblies are rather complex and costly to implement. The associated linkages are susceptible to wear and periodic maintenance is required to assure proper operation. The necessary frequent access to adjust the resistance element and effect desired increases or decreases in operating resistance are also not accommodated with many known exercise equipments.

Preferably an assembly is desired which has a minimal number of total parts and moving parts and a readily accessible selector mechanism which permits graduated changes in operating resistance. The assembly should also be modular. Accordingly, a number of hydraulically operated, modular frameworks have been developed. Each includes a closed loop hydraulic assembly having a restrictor valve that controls fluid flow to an operating cylinder with an exercise motion. A separating piston head assembly at a cylinder provides a static, appreciably reduced bypass flow and reduced resistance with return motion.

SUMMARY OF THE INVENTION

It is accordingly a primary object of the present invention to provide a closed loop hydraulic flow assembly which may be adapted to a variety of exercise equipments.

It is a further object of the invention to provide a closed loop hydraulic assembly which includes a user accessible, selectable restrictor valve assembly for controlling flow in at least one flow direction.

It is a further object of the invention to provide a restrictor valve assembly which includes a number of fluid bores of differing orifice size and which bores are independently alignable with a primary flow path.

It is a further object of the invention to provide a hydraulic assembly having a cylinder and piston head assembly which accommodates a controlled bypass of fluid in a return travel direction, opposite to a preferred exercise travel direction.

It is a further object of the invention to provide a piston head assembly which includes cooperating portions which mate to prevent back flow or bypass flow during piston travel in the preferred exercise direction and which separate to facilitate bypass flow during piston motion in the return direction.

It is a further object of the invention to provide alternate modularly configured, exercise frameworks which include manipulative and stationary frame sections that support and cooperate with the hydraulic assembly to promote exercise of various muscle groups.

It is a further object of the invention to provide exercise assemblies which include means for converting and visibly displaying the effort exerted by the user in units of conventional weight measure.

Various of the foregoing objects, advantages and distinctions of the invention are obtained in a presently preferred construction of a "bench press" exerciser. In the preferred construction, the hydraulic assembly comprises a closed loop system. The system includes a hydraulic cylinder having a piston which moves to and fro in relation to a user manipulated frame or carriage arm at the exercise apparatus. Fluid flow is directed through a user controlled restrictor valve assembly into a cylinder housing. A buffer reservoir, which is coupled to the cylinder housing, accommodates overflow requirements.

The restrictor valve includes a housing having inlet and outlet ports. A valve body, which includes a number of radially directed flow bores that open to a center cavity, is mounted to permit a selected alignment of one of the bores with a primary flow path or conduit coupled to the cylinder housing. The bores are radially exposed to the outlet port at the exterior of the valve body in a space between adjacent circumferentially mounted O'rings. A selector handle cooperates with detents at a cover to facilitate flow selection.

A piston assembly of the hydraulic cylinder includes a pair of cooperating disks or piston heads which seal to the walls of the cylinder housing and to one another during forward motion of the piston shaft in the exercise travel direction. The heads separate during reverse motion of the piston shaft in the return travel direction.

One of the heads is rigidly secured to the piston shaft. A circular row of bores coaxial with the piston shaft extend through the stationary head adjacent the piston shaft. A moveable head is mounted along the piston shaft forward of the stationary head and operates between a sealed position, where the head engages the stationary head, and a forward stop surface or flange cut into the piston shaft. A second row of through bores coaxial with the piston shaft is concentrically formed in the moveable head adjacent the interior wall of the cylinder housing. O'rings are secured to the outer circumference of the stationary and moveable heads. A separate, inner O'ring is secured to a transverse surface of the stationary head which mates with the moveable head in the space between the bores. The inner seal surrounds the bores of the stationary head.

During an exercise motion of the piston shaft, the piston heads abut one another and flow is prevented through the concentric rows of bores due to the intervening O'ring seal. During return motion, the moveable disks separate to permit a controlled flow of fluid through the head bores which bypasses the restrictor valve.

In a bench press exercise assembly, the hydraulic assembly is secured to a moveable arm which is suspended above a user support bench. An electronic sensor mounted to the bench measures and displays relative exertion of the users in relation to a transducer which mounts below the user's shoulders and back.

Other alternative exercise frameworks each provide frameworks having stationary and moving carriage frames. Various pivoting or sliding carriages are particularly provided, which are manipulated by the user to exercise various muscle groups, such as the chest, latissimus dorsi, legs and shoulders. The hydraulic assembly mounts between the stationary and carriage frames.

Still other objects, advantages and distinctions of the invention will become more apparent from the following detailed description with respect to the appended drawings. To the extent various modifications, improvements and alternative constructions have been considered they are described as appropriate. The following description should not be interpreted in strict limitation to the constructions described, but rather should be construed within the scope of the following appended claims.

DESCRIPTION OF THE PREFERRED EMBODIMENTS

Figure 1:
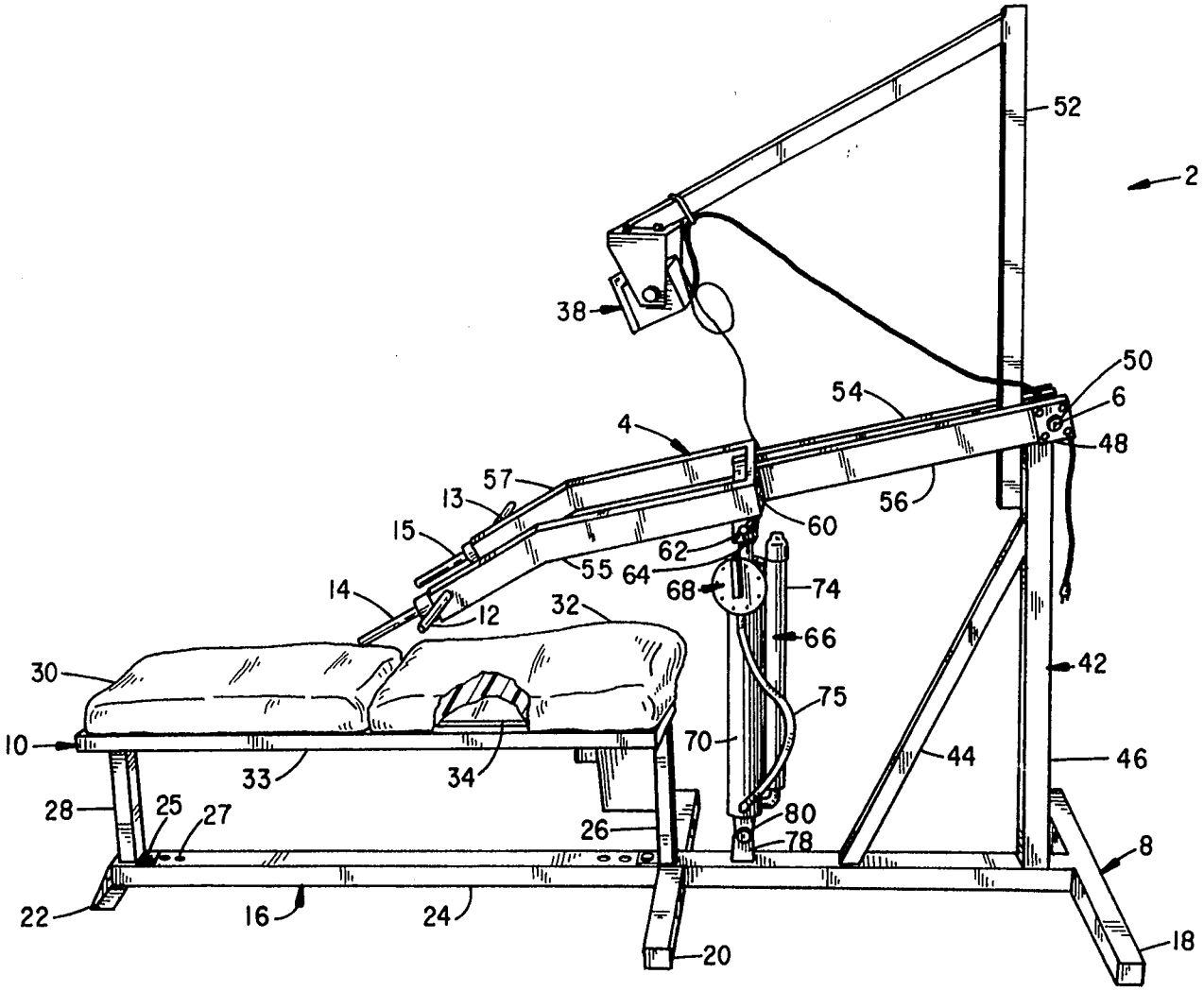
FIG. 1. is a perspective drawing of a "bench press" exerciser.

FIG. 1 depicts a perspective drawing of a so-called "bench press" exercise assembly 2. The assembly 2 permits a controlled physical exertion of the chest and upper shoulder muscles through repeated manipulation of a moveable framework or carriage arm 4 which is manipulated by a user to rotate about a pivot pin 6 at a stationary framework 8. In normal use, a user lies prone at a cushioned bench assembly 10 which is supported to the stationary framework 8. Two pairs of hand holds 12, 13 and 14, 15 extend from the arm 4 to permit alternative gripping actions by the user.

The stationary framework 8 includes a base assembly 16 having a number of frame members 18, 20 and 22, which are spaced apart along a longitudinal beam 24, to laterally support the assembly 2. A pair of vertical risers 26, 28 support the bench 10. The risers 26, 28 may be permanently welded to the beam 24. Alternatively, pin fasteners 25 can secure the risers 26, 28 to holes 27 provided along the beam 24. The bench assembly 10 includes a pair of padded cushions 30 and 32. The cushion 30 is rigidly secured to a bench frame 33.

As shown in a cutaway portion of the cushion 32, the cushion 32 is supported on a sensing surface of a transducer 34. The transducer 34 is secured to the bench frame 33. In the assembly 2, the transducer 34 comprises an electronic scale which is capable of weighing masses from 0 to 1,000 pounds. A model 1Q310-FA scale, such as manufactured by Rice Lake Weighing Systems, Rice Lake, Wis., is presently used as the transducer 34.

The transducer 34 is coupled to an electronic controller head 38 which includes a visual alphanumeric display 40, reference FIGS. 4 through 7. Appropriate control and programming or information keys 41 are also provided. For example, a "tare" key zeroes the scale, another key controls the power, and still other keys can be accessed to obtain pertinent exercise feedback information, such as number of repetitions, exercise time, calories consumed etc.. With the physical exertion of the user to push the handle holds 12, 13 or 14, 15 to raise the moveable arm 4, an equal and opposite downward exertion of the shoulders is measured by the transducer 34 and displayed at the controller head 38.

Supported to a fore end of the stationary frame 8 is an upright stanchion assembly 42. A counter brace 44 partially supports a primary upright stanchion piece 46. The stanchion piece 46 includes a yoke end 48 having bored apertures which receive the pivot pin 6 and the moveable carriage arm 4.

Projecting from the stanchion piece 46 is a controller head support arm 52. The arm 52 is affixed to the stanchion piece 46 with suitable fasteners and supports the controller head 38 above the user such that the keys 41 and display 40 are accessible and visible during exercise activities, while lying prone or possibly standing or sitting at the bench 10 or other attachments to the stationary frame 8.

The carriage arm 4 includes a number of frame members which are assembled to form a Y-shaped yoke assembly. A pair of members 54, 56 are bored to accept the pivot pin 6. Bushings may be included at bores 50 to facilitate the normal pivoting motion of the arm 4.

The hand holds 12, 13 and 14, 15 project from frame members 55 and 57 to permit alternative gripping actions, depending upon the particular exercises being performed. A cross frame member 60 supports a pin fastener 62 which mates with a yoke end 64 at a piston shaft 76 of a closed loop hydraulic assembly 66, see also FIG. 3. A second yoke 78 and pin 80 secure the lower end of a cylinder 70 to the stationary framework 8.

The hydraulic assembly 66 provides a controlled resistance to movement of the carriage arm 4. That is, as the user attempts to raise the arm 4 over an exercise travel path, the hydraulic assembly 66 resists the motion with a constant opposite force determined from a selected setting at a restrictor valve assembly 68, which projects from the side of the hydraulic assembly 66, reference FIG. 2. The assembly 68 is positioned to permit ready access by the user with or without leaving the bench 10. A bypass capability of the hydraulic assembly 66, which is discussed below with respect to FIG. 3, provides a relatively free and unrestricted resistance to a lowering of the arm 4 over a return travel path. The rate of movement of the arm 4 in the return direction can be increased by pulling on the hand holds 12, 13 and 14, 15. The arrows of FIG. 3 depict the typical flow of hydraulic oil through the cylinder 70 in relation to the axial motion of a piston shaft 76 and piston head assembly 72, which are seated within the cylinder 70, during exercise and return motions of the arm 4.

The hydraulic assembly 66 includes the restrictor valve assembly 68, a hydraulic cylinder 70, and a buffer reservoir 4. The restrictor valve assembly 68 and reservoir 74 mount to the cylinder 70 with threaded connections capable of withstanding normal operating pressures in the range of 0 to 2500 psi. A length of liquid conduit 75 couples an outlet side of the valve assembly 68 to one side of a piston head at the cylinder 70. The inlet of the valve assembly 68 is coupled to the opposite side of the piston head.

With attention to FIG. 3 and during the resistance or exercise stroke, the user, who is typically lying prone on the bench 10, attempts to raise the carriage arm 4. Hydraulic fluid is correspondingly forced from the space forward of the piston head assembly 72, through the restrictor valve assembly 68 and into the space aft of the piston head assembly 72 and/or into the reservoir 74. The effort to raise the carriage arm 4 is determined by the restrictor valve 68. The valve assembly 68 combined with the length of the carriage arm 4 provides a selected fluid flow corresponding to a weight range such as experienced by a user when lifting 0 to 1000 pounds of conventional weights. The manner of establishing a weight setting and structure for obtaining same are discussed in greater detail below with respect to FIG. 2.

During the retraction of the piston head assembly 72, when the user pulls down on the carriage arm 4, the resistance of the restrictor valve 68 is bypassed with a decoupling of a moveable disk 82 of the piston head assembly 72 from an adjoining stationary disk 84. The separation of the disks is limited by a flanged surface or ledge 85 cut into the piston shaft 76. Ports or longitudinal bores 86 and 88 which are formed through the disks 82, 84 and exposed with the separation, permit a substantial portion of the hydraulic fluid aft of the piston head assembly 72 to flow through the separated disks 82, 84. More of the details of the piston head assembly 72 are described below.

The net result is a substantially reduced degree of effort to retract the piston shaft 76. The specific degree of reduction depends upon the number, size and total aperture area presented by the ports 86, 88. A presently preferred arrangement of 24 ports 88 and 14 ports 86 allows the carriage arm 4 to return to a fully depressed or "rest" position, due to its own weight, over a period of approximately two seconds. The ports 88 have a hole size in the range of 0.180 to 0.200 inches and the ports 86 have a hole size in the range of 0.140 to 0.156 inches.

Figure 2:
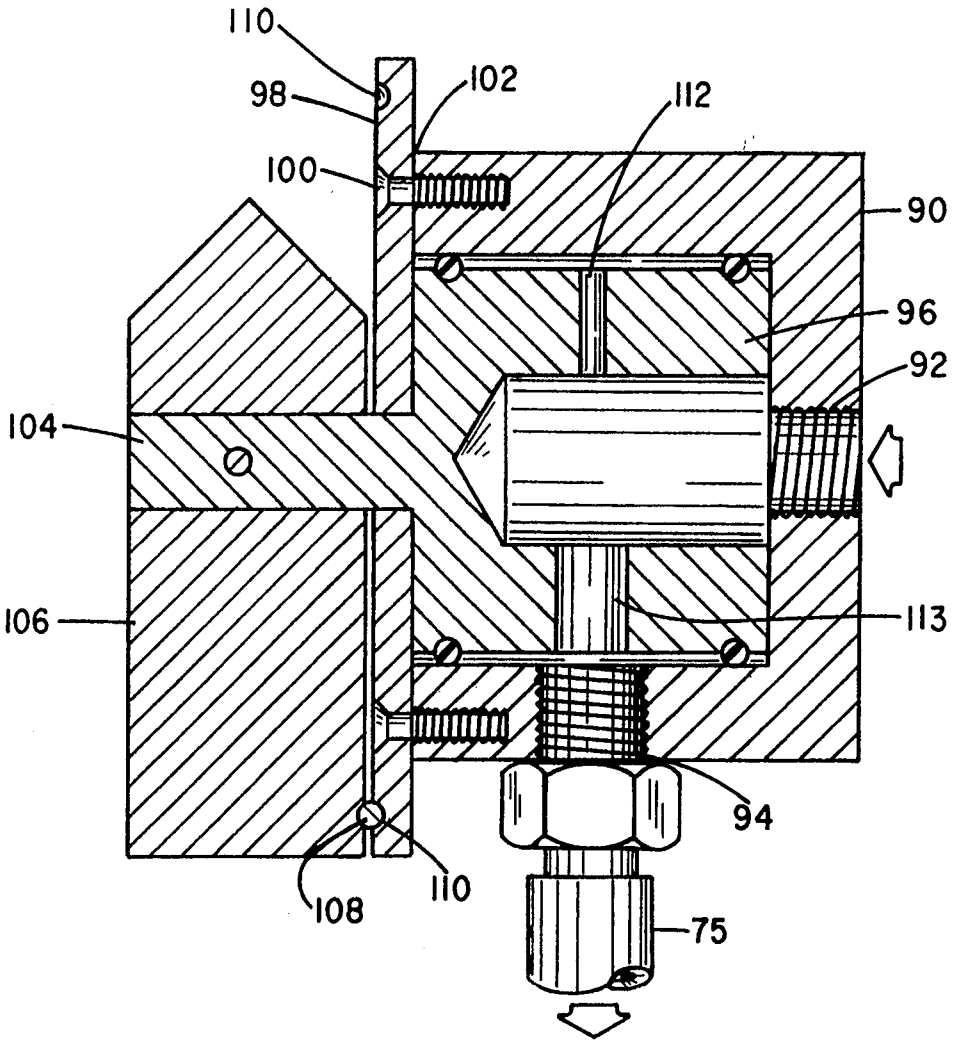
FIG. 2 is a cross section drawing through the restrictor valve assembly.
Figure 3:
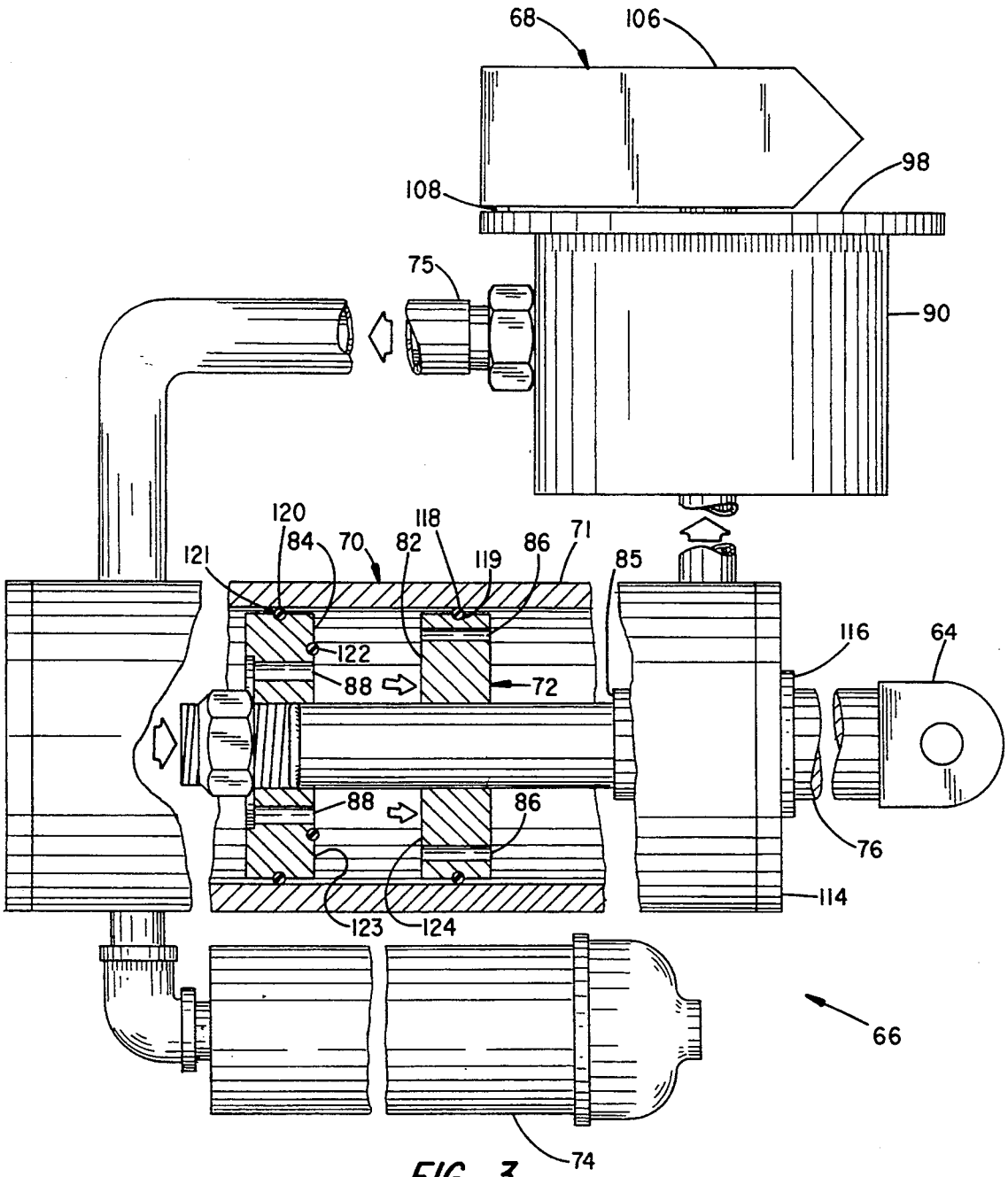
FIG. 3 is a plan view drawing of the hydraulic assembly and depicts a cutaway section view through the hydraulic cylinder.

With attention to FIG. 2, a cross section view is shown through the restrictor valve assembly 68. The assembly 68 includes a housing 90 which has threaded inlet and outlet ports 92 and 94. A valve body 96 mounts within the housing 90 beneath a cover 98. The cover 98 is secured to the housing 90 with a number of threaded fasteners 100 and an intermediate seal 102. A stem piece 104 projects from the valve body 96 and mates with a handle 106. The handle 106 includes a resiliently biased detent 108 which mates with a number of depressions 110 formed about the exposed face of the cover 98. Upon rotating the valve body 96, a selected position is maintained through the cooperation of the detent 108 with the depressions 110.

Aligned to each detent position within the valve body 96 is a radially directed orifice or bore. Presently, eight bores are provided. Only two bores 112 and 113 are depicted. The size of each valve body orifice varies from position to position. The alignment of a desired orifice, such as the bore 113, to the outlet port 92, allows the equipment user to selectively vary the effective size of the flow path and thereby control the pressure necessary to operate the piston shaft 76. At present, the eight valve body orifices are sized in increments of 1/16 inch over a range of 1/16 to ½ inch, the inside diameter of the conduit 75 is approximately ½ inch, and the inside diameter of the cylinder housing 71 is approximately 2.0 inches.

A cross section view is shown to the construction of the cylinder assembly 66 at FIG. 3. The cylinder assembly 66 comprises a conventional hydraulic cylinder 70 having a housing 71 which contains motion of the piston shaft 76. The shaft 76 travels within the housing 71 in relation to a differential fluid pressure on either side of the piston head assembly 72. The piston shaft 76 passes through a cover 114 having a shaft seal 116.

In distinction to conventional cylinders, the piston head assembly 72 provides a pair of moveable and stationary disks 82 and 84. Each disk 82, 84 includes an O'ring seal 118, 120 which mounts within a groove 119, 121 formed within an outer circumferential surface of each disk 82, 84. The seals 118, 120 prevent undesired bypass of fluids around the piston head assembly 72.

The bypass ports 88 of the stationary disk 84 are drilled through the disk 84 adjacent the piston shaft 76. Presently 14 ports 88 are provided. The moveable disk 82 is similarly constructed, although includes 24 ports 86, which are concentrically arranged adjacent the interior housing walls.

Concentrically positioned and surrounding the ports 88 is an O'ring 122 which is formed into a forward surface 123 of the stationary disk 84. The seal 122 is mounted to contact the aft surface 124 of the disk 82 in the space between the ports 86, 88. The mating surface 124 may or may not include a groove which mates with the seal 122, depending upon the durometer of the seal 122.

Depending, too, upon the system, the buffer reservoir 74 may not be required. However, the extraneous reservoir 74 permits a reduction in the size of the cylinder 70, which produces a corresponding reduction in cost of the assembly 2. Presently a cylinder having a stroke length of 18 to 30 inches is preferred for each of the apparatuses disclosed at FIG. 1 and 4 through 7. It is to be appreciated cylinders 70 having greater or lesser piston travel or inside diameters can be used.

Figure 4:
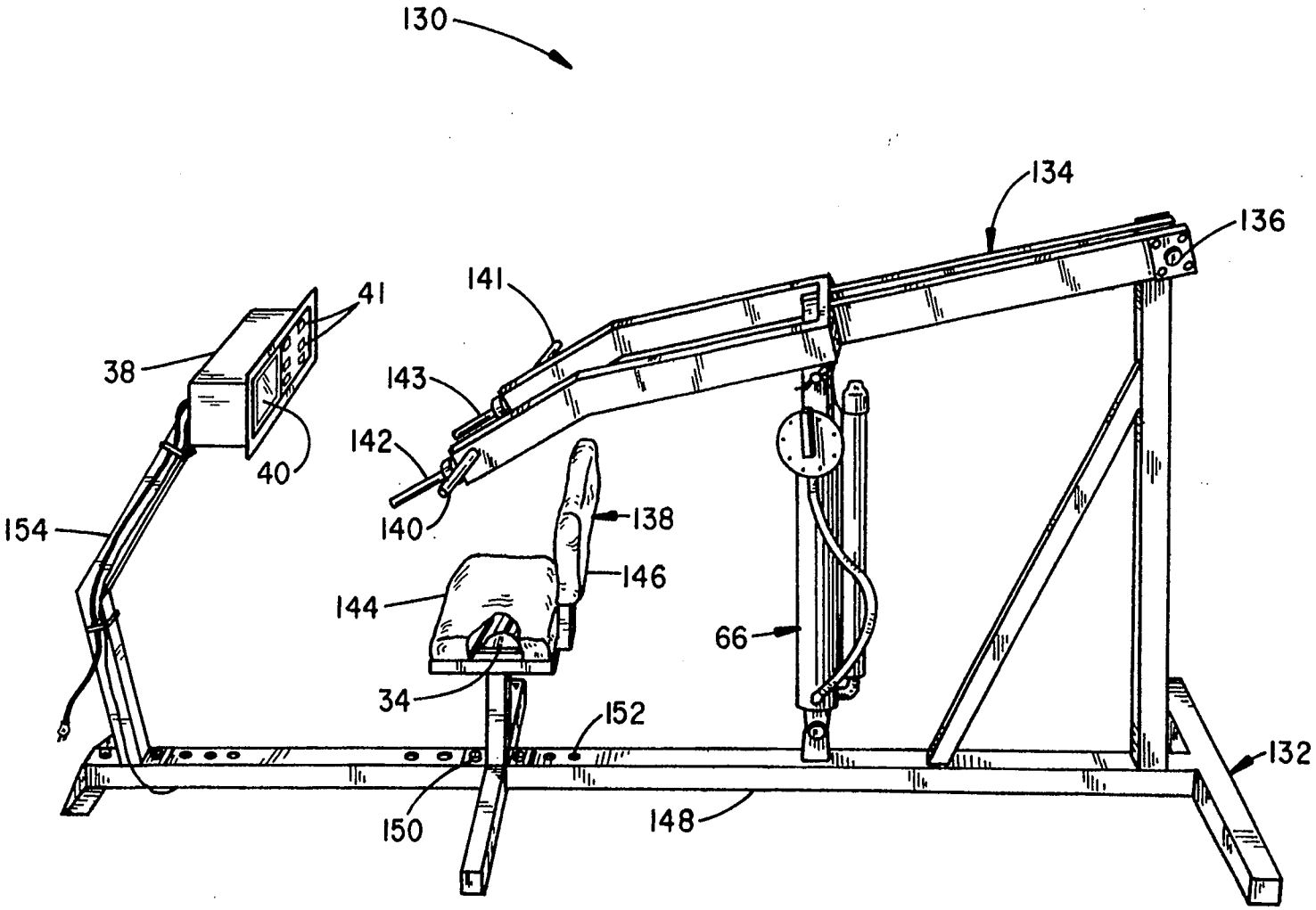
FIG. 4 is a perspective drawing of a "seated press" exerciser.

Referring next to FIG. 4, a perspective drawing is shown of a piece of exercise equipment 130 which finds application for exercising the legs. FIG. 4 particularly discloses a "seated press" exercise assembly 130. The assembly 130 includes a stationary frame 132 and a carriage arm 134 which pivots with respect to the stationary frame at a pivot pin 136. As with the assembly 2, the framework is constructed of pieces of tubular and angular steel which are appropriately dimensioned, sized, welded and/or bolted to the configuration depicted.

In lieu of a bench 10, a seat assembly 138 is secured to the stationary frame 132 in proximity to hand holds 140, 141 and 142, 143 at the carriage arm 134. The seat 138 includes a seat cushion 144 and backrest 146. A transducer 34 mounts beneath the seat cushion 144. The position of the seat 138 along a longitudinal beam 148 can be varied with an appropriate positioning of a pinned restraint 150 to one of a number of apertures 152 at the beam 148.

A control head support arm 154 projects from a fore end of the beam 148 to support the control head 38 in proximity to the user for viewing and other appropriate keyed actions. The degree of exertion required to manipulate the arm 134 is again dependent upon a selected setting at a hydraulic assembly 66 which is supported between the moveable and stationary frames 134 and 132.

Figure 5:
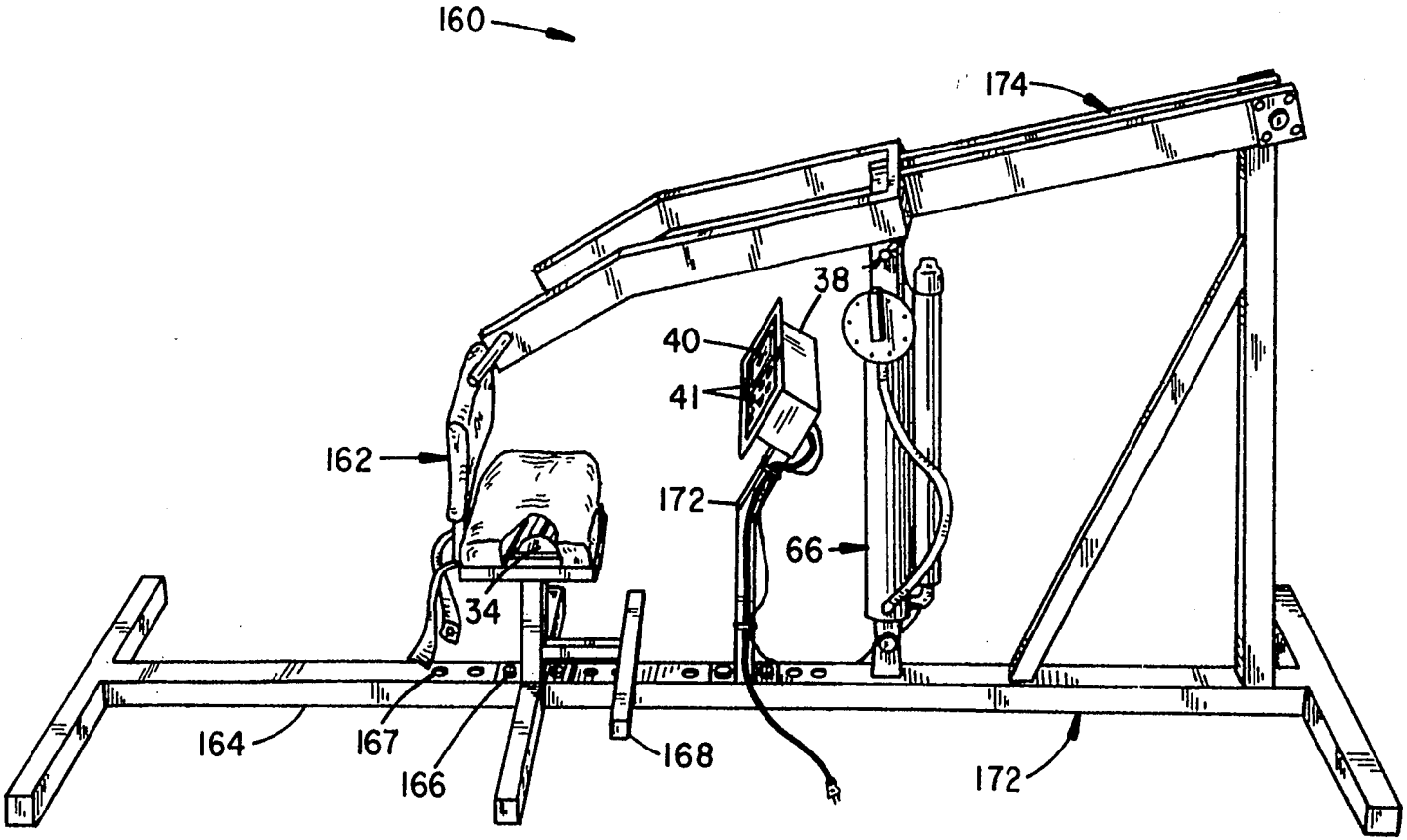
FIG. 5 is a perspective drawing of a "lat" exerciser.

FIG. 5 discloses another piece of exercise apparatus 160 which finds application for exercising the latissimus dorsi muscles. The assembly 160 is substantially similar to that of the seated press assembly 130, except for the relative mounting position of a seat 162 and the control head 38 along a longitudinal frame member 164. The mounting position of the seat 162 can be varied with appropriate placement of a pin fastener 166 at holes 167 provided along the member 164. A foot rest 168 radially projects from an upright member 170 of the seat assembly 162.

A control head support arm 172 mounts between the seat 162 and a hydraulic assembly 66. The assembly 66 is again restrained between the stationary frame 172 and a carriage arm 174.

Although FIGS. 1, 4 and 5 depict separate pieces of exercise apparatus 2, 130 and 160, it is to be appreciated the assemblies can be obtained in a single modular configuration. For such a construction, the numerous apertures shown at the members 24, 148 and 164 can be combined at a single longitudinal frame member to obtain selective mounting of an appropriate control head support arm 52, 154 or 172, seat assembly 138 or 162 and bench assembly 10 to the longitudinal frame member. Such couplings can be effected with the depicted pin fasteners or with sleeve couplers having interlocking slide pieces or other known interconnecting fasteners that extend between the longitudinal frame member and each of the supported assemblies.

Figure 6:
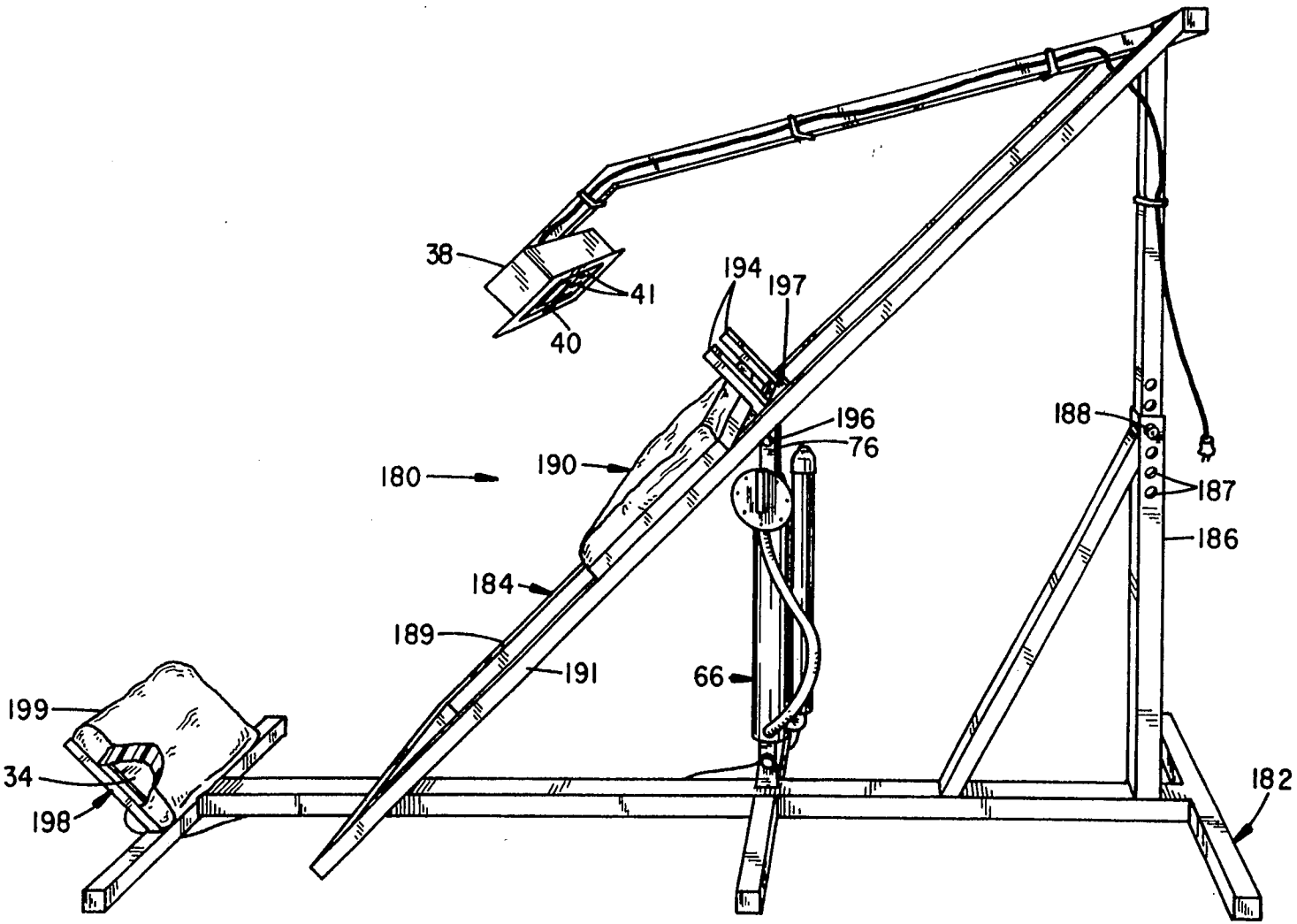
FIG. 6 is a perspective drawing of a "leg press" exerciser.

FIG. 6 depicts a "leg press" exercise assembly 180. The assembly 180 includes a stationary base frame 182 and a user support frame 184 which mounts to an upright stanchion 186. The angle of the user frame 184 can be varied upon appropriately positioning a pin restraint 188 at a selected aperture 187 along the stanchion 186.

Mounted along the user support frame 184 is a sliding cushioned support frame 190. A variety of cooperating wheels, rollers or the like (not shown) are secured to a portion of the slide frame assembly 190, which permit the frame 190 to move to and fro along the frame members 189 and 191. A cushion 192 projects from the slide frame 190 to support the user. A pair of projecting uprights 194 also extend from the frame 190 and between which the head of the user is typically supported. Additional cushioned supports may be included to support the head as desired. A multiaxis universal joint 196 is supported between the piston shaft 76 of the hydraulic assembly 66 and a cross member 197 of the support frame 184.

A foot support assembly 198 is secured along the base frame 182 in proximity to the support frame 184. A transducer 34 is supported to the footrest assembly 198 and upon which the user normally places his or her feet. During exercise and with appropriate exertion of the legs against the footrest assembly 198, the sliding frame 190 moves up and down along the angularly positioned support frame 184. A cushion 199 is also shown and which has use if an opposite exercise posture is adopted and the feet are brought to bear against the uprights 194.

Figure 7:
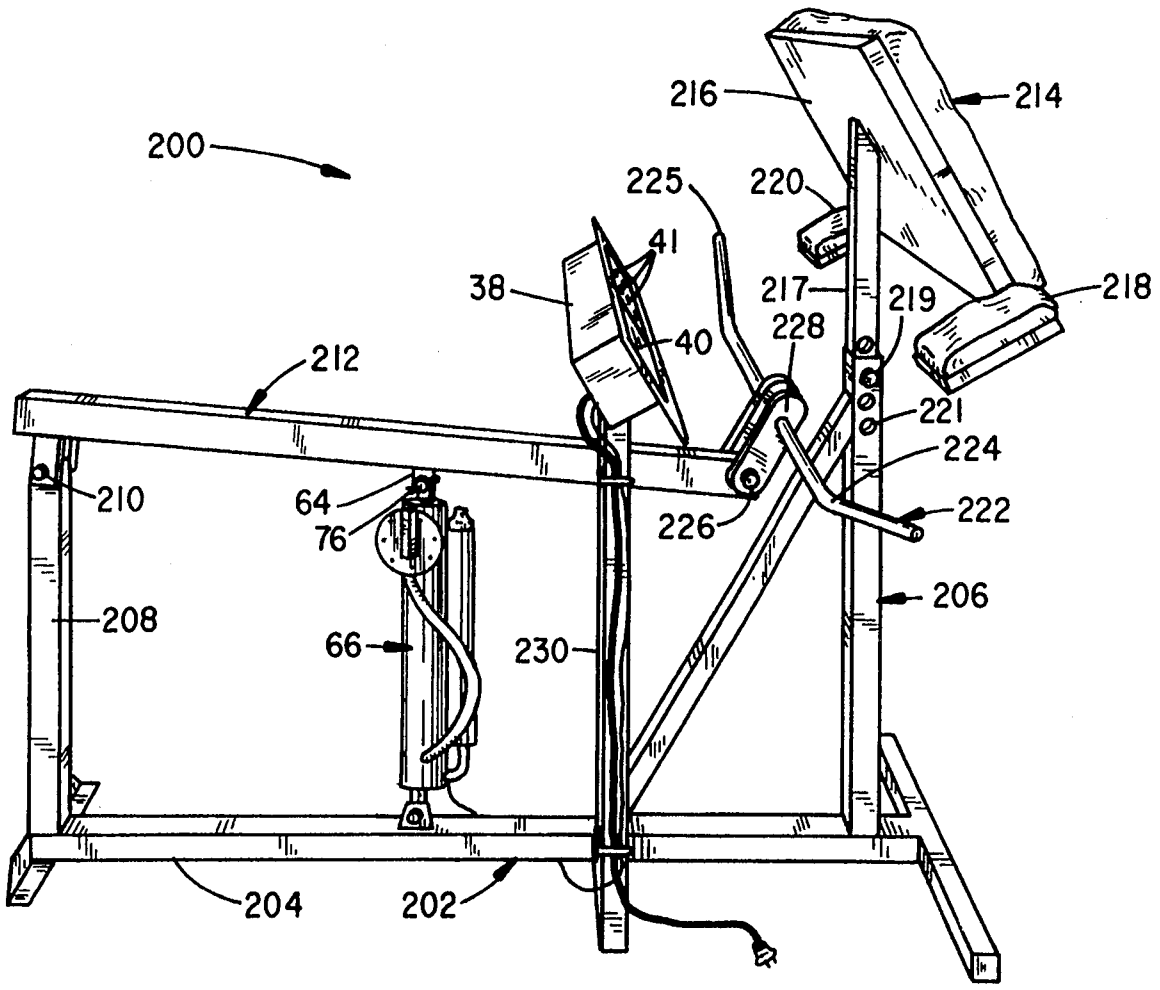
FIG. 7 is a perspective drawing of a "curl" exerciser.

FIG. 7 lastly depicts a so-called "curl" exercise assembly 200. The assembly 200 includes a stationary base frame 202 having a longitudinal beam 204. Secured at one end of the frame 202 is a length adjustable, upright stanchion assembly 206. Secured to an opposite end of the frame 202 is a pivot stanchion 208. A hydraulic assembly 66 is secured to the frame 202 between the stanchions 206 and 208. Pivotally secured to the pivot stanchion 208 at a pivot pin 210 is a carriage arm 212. The carriage arm 212 is also secured to the yoke 64 of the piston shaft 76.

Mounted to the stanchion 206 is a cushioned user support assembly 214. A center cushion 216 is secured to a column 217, the height of which can be adjusted upon positioning a pin 219 at holes 221 in the stanchion 206. The cushion 216 is normally positioned to support the chest of a user. Adjoining wing arms 218 and 220 support the upper arms of a user. Upon supporting the chest and upper arms of a user, the user grasps a handle bar assembly 222 having handholds 224, 225 which is secured to the moveable arm 212 at a pivot pin 226 and linkage arm 228. Upon raising and lowering the handlebar 222, appropriate exercise is obtained with respect to the hydraulic assembly 66.

Also mounted along the stationary frame member 204 is a control head support arm 230. A control head 38 is positioned to the arm 230 to facilitate viewing and programming by the user.

While the invention has been described to various presently preferred exercise assemblies and alternatively considered improvements and modifications thereto, still other constructions may suggest themselves to those skilled in the art. The following claims accordingly should be interpreted to include all those equivalent embodiments within the profit and scope thereof.

What is claimed is:

1. Exercise apparatus comprising:

(a) a stationary frame, a carriage frame, support means for supporting a user to manipulate said carriage frame and including scale means for determining a relative magnitude of physical exertion expended by the user to move said carriage frame and for displaying expended energy, and means for retaining said carriage frame to said stationary frame to permit movement of said carriage frame over a predetermined travel path; and (b) hydraulic means coupled to said stationary and carriage frames for directing a fluid media in a closed loop flow path with movement of said carriage frame, such that a greater resistance to flow is obtained over an exercise portion of said travel path than over a return portion of said travel path.

2. Apparatus as set forth in claim 23 wherein said hydraulic means comprises:

(a) a hydraulic cylinder having a piston head mounted within a housing containing said fluid media and coupled to a piston shaft;

(b) means for directing fluid flow to opposite sides of said piston head; and (c) means for coupling said cylinder between said stationary and carriage frames such that fluid flow is directed to opposite sides of said piston head as said piston shaft extends and retracts with movement of said carriage flow.

3. Apparatus as set forth in claim 2 wherein said piston head comprises first and second separable portions, wherein each of said first and second portions includes seal means for engaging an interior surface of said housing and wherein one of said first and second portions includes seal means for mating with a surface of the other of said first and second portions to isolate a first plurality of bores in one of said first and second portions from a second plurality of bores in the other of said first, and second portions.

4. Apparatus as set forth in claim 3 wherein one of said first and second portions is rigidly secured to said piston shaft and the other of said first and second portions is axially moveable along said piston shaft between a bypass position at which said first and second portions are separated and a sealed portion at which the first and second portions mate to one another.

5. Apparatus as set forth in claim 3 including stop means at said piston shaft for limiting the separation of said first and second portions.

6. Apparatus as set forth in claim 1 including means for programming a zero reference at said scale means.

7. Exercise apparatus comprising:

(a) a stationary frame, a carriage frame, support means for supporting a user to manipulate said carriage frame, and means for retaining said carriage frame to said stationary frame to permit movement of said carriage frame over a predetermined travel path; and (b) hydraulic means coupled to said stationary and carriage frames for directing a fluid media in a closed loop flow path with movement of said carriage frame and comprising 1) a hydraulic cylinder having a piston shaft and a piston head, wherein said piston head is mounted within a housing containing said fluid media and includes first and second portions, wherein each of said first and second portions includes seal means for engaging an interior surface of said housing, and wherein one of said first and second portions includes seal means for mating with a surface of the other of said first and second portions to isolate a first plurality of bores in one of said first and second portions from a second plurality of bores in the other of said first and second portions, and 2) means for directing fluid flow to opposite sides of said piston head and alternately separating and coupling said first and second portions to one another, whereby as the piston shaft extends and retracts with movement of said carriage frame a greater resistance to flow is obtained over an exercise portion of said travel path than over a return portion of said travel path and over which return path a portion of said fluid passes through said first and second plurality of bores.

8. Apparatus as set forth in claim 7 wherein the flow directing means includes restrictor means for selectively varying the fluid flow through a portion of the flow path.

9. Apparatus as set forth in claim 8 wherein said restrictor means includes a plurality of orifices and means for selectively aligning at least one of said orifices with the flow path and wherein each orifice has a different bore dimension from each other orifice.

10. Apparatus as set forth in claim 8 wherein said restrictor means comprises:

(a) a second housing including an inlet port coupled to said cylinder housing forward of said piston head and an outlet port coupled to said cylinder housing aft of said piston head;

(b) a valve body mounted in said second housing including a cavity communicating with said outlet port and having a plurality of bores communicating between said cavity and an exterior surface of said body;

(c) selector means for rotating said valve body to position a selected one of said bores in a predetermined alignment with said inlet port; and (d) means for sealing said valve body to said second housing and permitting fluid flow from said inlet port to said outlet port only through the selected one of said bores.

11. Apparatus as set forth in claim 10 wherein said selector means includes actuator means for rotating said valve body and means cooperating with said actuator means for maintaining said valve body at a selected bore alignment.

12. Apparatus as set forth in claim 7 wherein said support means includes scale means for determining a relative magnitude of physical exertion expended by the user to move said moveable carriage frame.

13. Apparatus as set forth in claim 12 wherein said scale means includes means for displaying expended energy.

14. Apparatus as set forth in claim 13 including means for programming a zero reference weight at said scale means.

15. Apparatus as set forth in claim 7 wherein said support means comprises a plurality of attachments, each of which attachments support a portion of a user's anatomy and each of which attachments are selectively mountable along a longitudinal frame piece of said stationary frame at a plurality of exercise positions.

16. Apparatus as set forth in claim 15 wherein one of said attachments comprises a chair having seat and backrest portions.

17. Apparatus as set forth in claim 7 wherein an upright member projects from said stationary frame, wherein said carriage frame comprises an arm which is secured to said upright member at a pivot means for pivoting said arm, and wherein said arm includes a handlebar and means for pivotally coupling said handlebar to said arm.

18. Apparatus as set forth in claim 17 wherein said support means comprises an upright stanchion having a first cushion means for supporting the chest of a user and second cushion means for supporting the arms of a user, and wherein said stanchion includes means for vertically adjusting a displacement of said support means to said handlebar.

19. Apparatus as set forth in claim 7 wherein said carriage frame is mounted to slide along said stationary frame.

20. Apparatus as set forth in claim 7 wherein said support means supports the feet of a user and includes means for determining a relative magnitude of physical exertion necessary to move said carriage frame.

21. Apparatus as set forth in claim 7 including stop means at said piston shaft for limiting the separation of said first and second portions.

22. Exercise apparatus comprising:

(a) a stationary frame, a carriage frame, support means for supporting a user to manipulate said carriage frame, and means for retaining said carriage frame to said stationary frame to permit movement of said carriage frame over a predetermined travel path; and (b) hydraulic means coupled to said stationary and carriage frames for directing a fluid media in a closed loop flow path to opposite sides of a piston head with movement of said carriage frame, wherein said piston head comprises first and second portions mounted within a housing containing said fluid media, and wherein said first and second portions separate with fluid flow to one side of said head and include means for bypassing a portion of the fluid flow through said first and second portions, whereby as a piston shaft axially extends and retracts with movement of said carriage frame, a greater resistance to flow is obtained over an exercise portion of said travel path than over a return portion of said travel path.

23. Exercise apparatus comprising:

(a) a framework including a stationary frame, a carriage frame and means for supporting a user to manipulate said carriage frame, means for retaining said carriage frame to said stationary frame to permit movement of said carriage frame over a predetermined travel path, and means for supporting a user; and (b) hydraulic means coupled to each of said stationary and carriage frames for directing a fluid media in a closed loop flow path with movement of said carriage frame, such that a greater resistance to flow is obtained over an exercise portion of said travel path than over a return portion of said travel path, wherein said hydraulic means comprising;

(1) a hydraulic cylinder having a piston head mounted within a cylinder housing and coupled to a piston shaft, which piston shaft moves to and fro in response to movement of the carriage frame, wherein said piston head comprises first and second portions, wherein one of said first and second portions is axially moveable along the piston shaft, wherein each of said first and second separable portions includes seal means for engaging an interior surface of said cylinder housing and wherein one of said first and second portions includes seal means for mating with the other of said first and second portions to isolate a first plurality of bores in one of said first and second portions from a second plurality of bores in the other of said first and second portions;

(2) restrictor means for selectively obstructing fluid flow through the flow path with motion of said piston head in the exercise travel direction, wherein said restrictor means comprises, i) a second housing including an inlet port coupled to said cylinder housing forward of said piston head and an outlet port coupled to said cylinder housing aft of said piston head, ii) a valve body mounted in said housing including a cavity communicating with said outlet port and having, a plurality of bores communicating between said cavity and an exterior surface of said body, and iii) means for rotating said valve body to position a selected one of said bores in a predetermined alignment with said inlet port, and iv) means for sealing said valve body to said second housing and limiting flow from said inlet to said outlet port only through the selected one of said bores.

* * * * *